US011260677B2

(12) United States Patent
Yoda

(10) Patent No.: US 11,260,677 B2
(45) Date of Patent: Mar. 1, 2022

(54) HEATING DEVICE, AND RECORDING DEVICE WITH A DETECTION UNIT

(71) Applicant: SEIKO EPSON CORPORATION, Tokyo (JP)

(72) Inventor: Tomohiro Yoda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/181,774

(22) Filed: Feb. 22, 2021

(65) Prior Publication Data

US 2021/0260897 A1 Aug. 26, 2021

(30) Foreign Application Priority Data

Feb. 25, 2020 (JP) ..... JP2020-029119

(51) Int. Cl.
*B41J 11/00* (2006.01)
*B41J 11/04* (2006.01)

(52) U.S. Cl.
CPC ..... *B41J 11/00242* (2021.01); *B41J 11/04* (2013.01)

(58) Field of Classification Search
CPC ..... B41J 11/00242; B41J 11/04
See application file for complete search history.

(56) References Cited

U.S. PATENT DOCUMENTS 10,245,851 B2 * 4/2019 Nakano ..... B41J 11/002
2011/0267393 A1 * 11/2011 Okamoto ..... B41J 11/0022 347/14
2020/0101766 A1 * 4/2020 Kizaki ..... B41J 11/002

FOREIGN PATENT DOCUMENTS

JP 2014-162108 9/2014
JP 2020-049866 4/2020

* cited by examiner

*Primary Examiner* — Bradley W Thies
(74) *Attorney, Agent, or Firm* — Workman Nydegger

(57) ABSTRACT

A heating device includes a support member including a support face, a first heating unit heating the support face, a second heating unit heating the support face, and a control unit independently controlling an output of the first heating unit and an output of the second heating unit. A second heated region is positioned adjacent to a first heated region. The first heating unit and the second heating unit are arranged, in order, from a center, in the width direction, of the support face toward an end thereof. A second detection unit detecting a temperature of the support face is provided in the second heated region, at a location further to an opposite side from the first heating unit than a center, in the width direction, of the second heated region. The control unit controls an output of the second heating unit based on detection of the second detection unit.

6 Claims, 5 Drawing Sheets

HEATING DEVICE, AND RECORDING DEVICE WITH A DETECTION UNIT

The present application is based on, and claims priority from JP Application Serial Number 2020-029119, filed Feb. 25, 2020, the disclosure of which is hereby incorporated by reference herein in its entirety.

BACKGROUND

1. Technical Field

The present disclosure relates to a heating device and a recording device.

2. Related Art

In known art, in a printer having a heating function for fixing ink ejected onto a medium, a configuration is known in which a heating unit is provided on a support surface with which the medium comes into contact. Note that, in such a printer, a heat radiation amount at both of end portions of the support surface is large, and unevenness occurs in the temperature of the heated medium. Therefore, in a recording device (printer) of JP-A-2014-162108, a configuration is disclosed in which a wiring density per unit area of a heater, which is a heating unit, is increased toward end portions (both end portions of the support surface) in a scanning direction.

However, in the recording device described in JP-A-2014-162108, a ratio is constant between a heating amount of the end portions for which the wiring density per unit area of the heater is high, and a heating amount of a central portion for which the wiring density is low. Therefore, depending on a temperature of the environment in which the recording device is installed, there is a concern that a difference remains between the temperature of the medium at the end portions of the support surface and the temperature of the medium at the center of the support surface. There is thus an issue to suppress the temperature difference between the end portions and the center portion of the medium that comes into contact with the support surface.

SUMMARY

A heating device includes a support member including a support face extending in a width direction of a medium and configured to support the medium onto which a liquid is ejected, a first heating unit provided at the support member and configured to heat the support face contacted by the medium, a second heating unit provided at the support member and configured to heat the support face, and a control unit configured to control an output of the first heating unit, and to control an output of the second heating unit independently of the output of the first heating unit. A second heated region heated by the second heating unit is positioned adjacent to a first heated region heated by the first heating unit. The first heating unit and the second heating unit are arranged, in order, from a center of the support face toward an end of the support face in the width direction. A second detection unit configured to detect a temperature of the support face is provided in the second heated region heated by the second heating unit, at a location further to an opposite side from the first heating unit than a center of the second heated region in the width direction, and the control unit controls an output of the second heating unit based on detection by the second detection unit.

A recording device includes the above-described heating device.

DESCRIPTION OF EXEMPLARY EMBODIMENTS

1. First Embodiment

Figure 1:
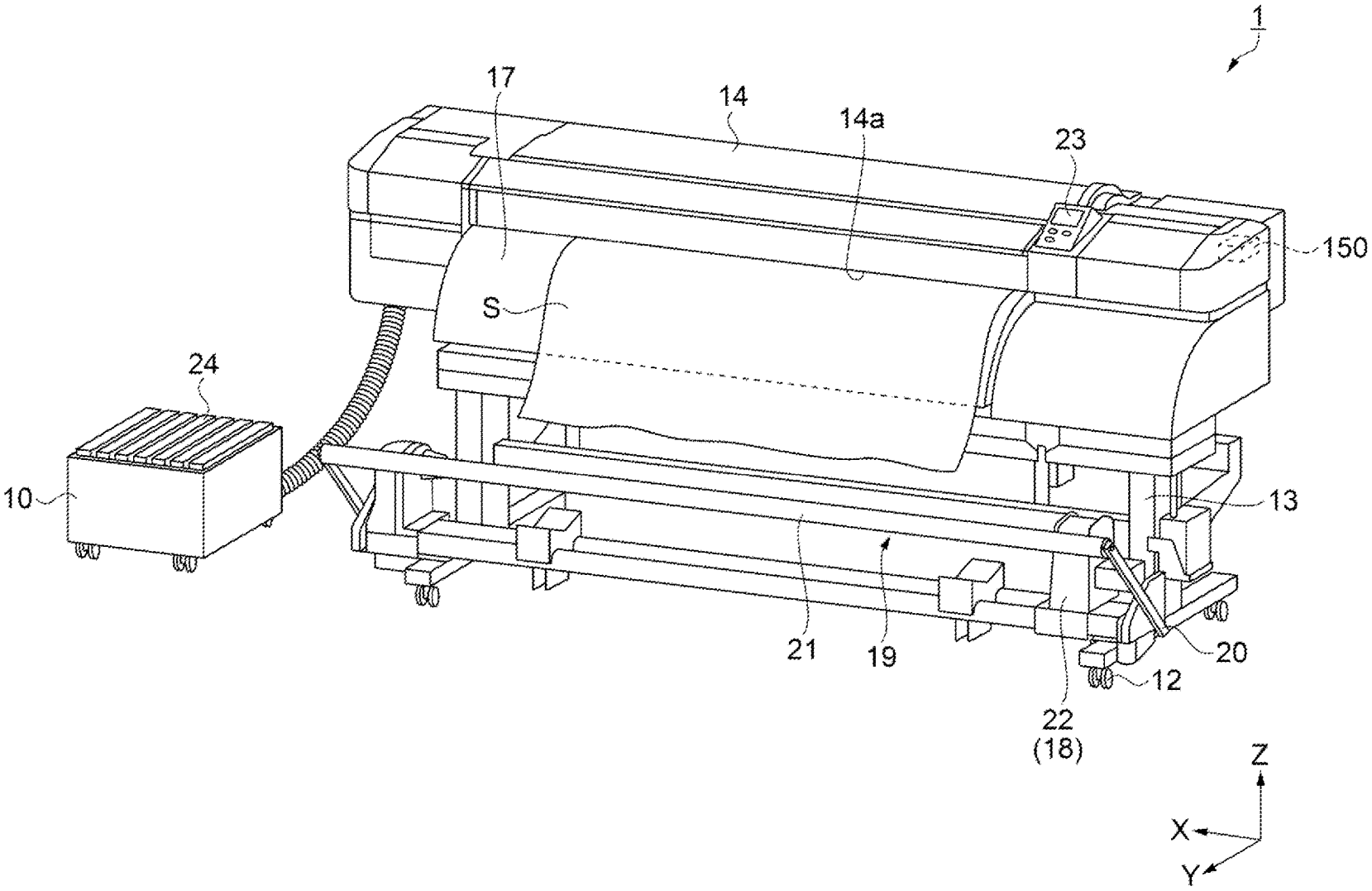
FIG. 1 is a perspective view illustrating a printer according to a first embodiment.

FIG. 1 describes a schematic configuration of a printer 1 that is a recording device according to a first embodiment. Note that, in each of the drawings below, a scale of each of components is different from the actual scale in order to make the size of each of the components recognizable.

As illustrated in FIG. 1, the printer 1 according to the present embodiment illustrates an example of the recording device. The printer 1 is a large format printer (LFP) that handles a long sheet S, which is an example of a medium. Then, the printer 1 is provided with a pair of legs 13 with casters 12 attached to lower ends thereof, and a housing 14 assembled to upper portions of the legs 13.

Note that each of the drawings below, including FIG. 1, are illustrated using an XYZ coordinate system. A Z direction is a direction along the gravitational direction and the vertical direction. Hereinafter, the Z direction is also referred to as an up-down direction or a height direction. An X direction intersects (in the present embodiment, is orthogonal to) the up-down direction, and is a lengthwise direction of the housing 14. Hereinafter, the X direction is also referred to as a width direction or a scanning direction. A Y direction is a direction that intersects (in the present embodiment, is orthogonal to) both the up-down direction and the width direction. Hereinafter, the Y direction is also referred to as a front-rear direction.

Further, in the front-rear direction, a side of the printer 1 that is a device front side or a device front face is referred to as a positive Y direction, and a device rear side or a device back face is referred to as a negative Y direction. Further, in the width direction, when the printer 1 is viewed from the front face side, a device left side is referred to as a positive X direction, and a device right side is referred to as a negative X direction. Further, in the up-down direction, the upper side, upward, an upper portion, an upper surface, and the like are referred to as a positive Z direction, and the lower side, downward, a lower portion, a lower surface, and the like, are referred to as a negative Z direction.

A feeding unit 15 (see FIG. 2) that feeds the sheet S toward the housing 14 side is installed below the device rear side of the housing 14. The sheet S according to the present embodiment is roll paper. Note that the printer 1 of the present embodiment is an ink jet-type printer that forms images by ejecting ink, which is a liquid, onto the sheet S.

Figure 2:
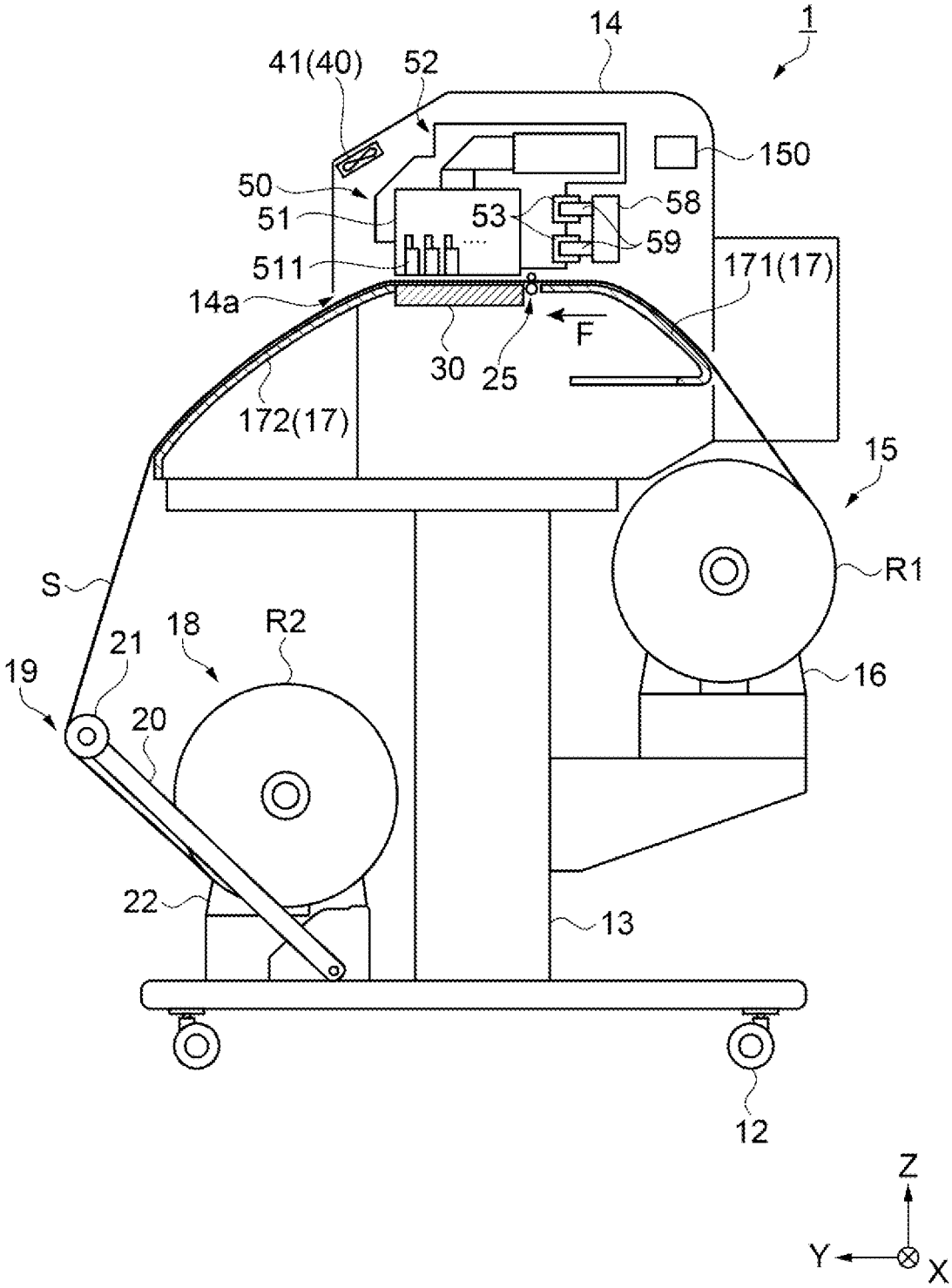
FIG. 2 is a cross-sectional view illustrating a schematic configuration of the printer.

As illustrated in FIG. 2, a winding unit 18, which is supported by the legs 13, is installed below the device front side of the housing 14. A medium guide unit 17 is installed along a transport path of the sheet S, between the feeding unit 15 and the winding unit 18. The medium guide unit 17 includes a feeding guide unit 171 installed on the feeding unit 15 side, and a winding guide unit 172 installed on the winding unit 18 side. Note that a platen 30 is installed in a form that couples the feeding guide unit 171 and the winding guide unit 172.

Of the medium guide unit 17, a rear end side of the feeding guide unit 171 is bent and housed inside the housing 14, and a front end side of the winding guide unit 172 protrudes to the front from the housing 14. Further, a discharge port 14*a* for discharging the sheet S from the housing 14 is formed in the front side of the housing 14 at a position above the medium guide unit 17.

As illustrated in FIG. 1, a control unit 150 that comprehensively controls operations of the printer 1 is installed inside the housing 14. Further, an operating panel 23 that is used for a setting operation or an input operation is installed on an upper portion of the housing 14, on the right side in the width direction. Note that the operating panel 23 is electrically coupled to the control unit 150.

A container box 10 that houses liquid storage containers 24 is installed separately from the housing 14 and the legs 13, below and to the device left side of the housing 14. The container box 10 houses a plurality of the liquid storage containers 24 corresponding to the types and colors of ink used in the printer 1. Note that, in the present embodiment, seven of the liquid storage containers 24 are housed. Thus, the printer 1 according to the present embodiment has a so-called off-carriage type configuration.

As illustrated in FIG. 2, the feeding unit 15 holds a roll body R1 around which the sheet S before printing is wound in a cylindrical shape. Note that a plurality of sizes of the roll body R1 that are different in a length in the width direction, which is the width of the sheet S, and have a different winding number can be exchangeably mounted on the feeding unit 15. Note that the feeding unit 15 is provided with a pair of holders 16 that sandwich a core member (a paper tube, for example) (not illustrated) on which the sheet S for printing is wound in a cylindrical shape.

Whatever the size of the roll body R1, in the present embodiment, for example, the roll body R1 is mounted on the feeding unit 15 in a state in which the roll body R1 is biased to a predetermined right-side end portion in the width direction. In other words, in the present embodiment, the predetermined right-side end portion in the width direction is set as a reference for positioning the sheet S. Then, when the feeding unit 15 rotates the roll body R1 in the counter-clockwise direction as illustrated in FIG. 2, the sheet S is unwound from the roll body R1 and fed to the inside of the housing 14.

A transport roller 25 that transports the sheet S, a printing unit 50, which is a recording unit that performs recording (printing) on the sheet S transported in a transport direction F by the transport roller 25, the platen 30 that supports the sheet S, and a suction mechanism (not illustrated) that sucks the sheet S are housed inside the housing 14. The suction mechanism sucks the upper surface of the platen 30 against the sheet S being transported, so as to adhere the sheet S to a support face 300 (see FIG. 3), which is the upper surface of the platen 30.

Note that a heating device 100 according to the present disclosure is applied to the platen 30 that is a support member. The configuration of the platen 30 will be described in detail below.

The printing unit 50 is disposed above and facing the platen 30. The printing unit 50 includes ejection heads 51 that eject the ink, which is the liquid, toward the sheet S sucked against the support face 300 of the platen 30. Further, the printing unit 50 includes a carriage 52 that is able to reciprocate in the scanning direction orthogonal to the transport direction F of the sheet S, in a state of holding the ejection heads 51.

The ejection head 51 is configured as a so-called inkjet head. A plurality of nozzles 511 are disposed in a high concentration in a direction orthogonal to the scanning direction, in each of the ejection heads 51. Further, the respective ejection heads 51 are disposed side by side in the scanning direction, for each of colors. In the present embodiment, seven of the ejection heads 51 are provided.

The carriage 52 is supported so as to be able to reciprocate with respect to two carriage shafts 59 that extend in parallel to the width direction and that are installed on a carriage frame 58. As illustrated in FIG. 2, the carriage 52 and the carriage shafts 59 of the present embodiment are engaged with each other via two bearings 53 fixed to the carriage 52, and the carriage 52 can reciprocate smoothly with respect to the carriage shafts 59.

When a print command is input via the operating panel 23, the control unit 150 performs the printing on the sheet S by comprehensively controlling the driving of each configuration of the printer 1. Specifically, the control unit 150 performs the printing on the sheet S by causing a transport operation, in which the transport roller 25 is driven to transport the sheet S by a unit transport amount in the transport direction F, and an ejection operation in which the ink is ejected from the ejection heads 51 while moving the carriage 52 in the scanning direction, to be alternately performed. When the ejection heads 51 eject the ink toward the sheet S, the ejection heads 51 and the platen 30 are disposed facing each other.

As illustrated in FIG. 2, the sheet S on which the printing is complete is guided diagonally downward along the winding guide unit 172 leading to downstream of the platen 30, and, after that, is wound around the winding unit 18 to form a roll body R2. Note that a tensioning mechanism 19 that is positioned between the winding guide unit 172 and the winding unit 18 and imparts tension to the sheet S is installed in the vicinity of the winding unit 18.

The tensioning mechanism 19 is provided with a pair of arm members 20 rotatably supported near the lower portions of the legs 13, and a tension roller 21 rotatably supported at tip portions of the pair of arm members 20. Further, the winding unit 18 is provided with a pair of holders 22 that sandwich a core member (a paper tube, for example) (not illustrated) that winds the sheet S after printing in a cylindrical shape.

As illustrated in FIG. 2, an air blowing mechanism 40 is disposed inside the housing 14, and blows air from diagonally above toward a first heated region 31 and a second heated region (see FIG. 3), which will be described later. In the air blowing mechanism 40, a plurality of fans 41 are installed side by side corresponding to the width direction of the sheet S. Note that the air blowing mechanism 40 operates to promote the drying of moisture of the ink ejected onto the sheet S.

Figure 3:
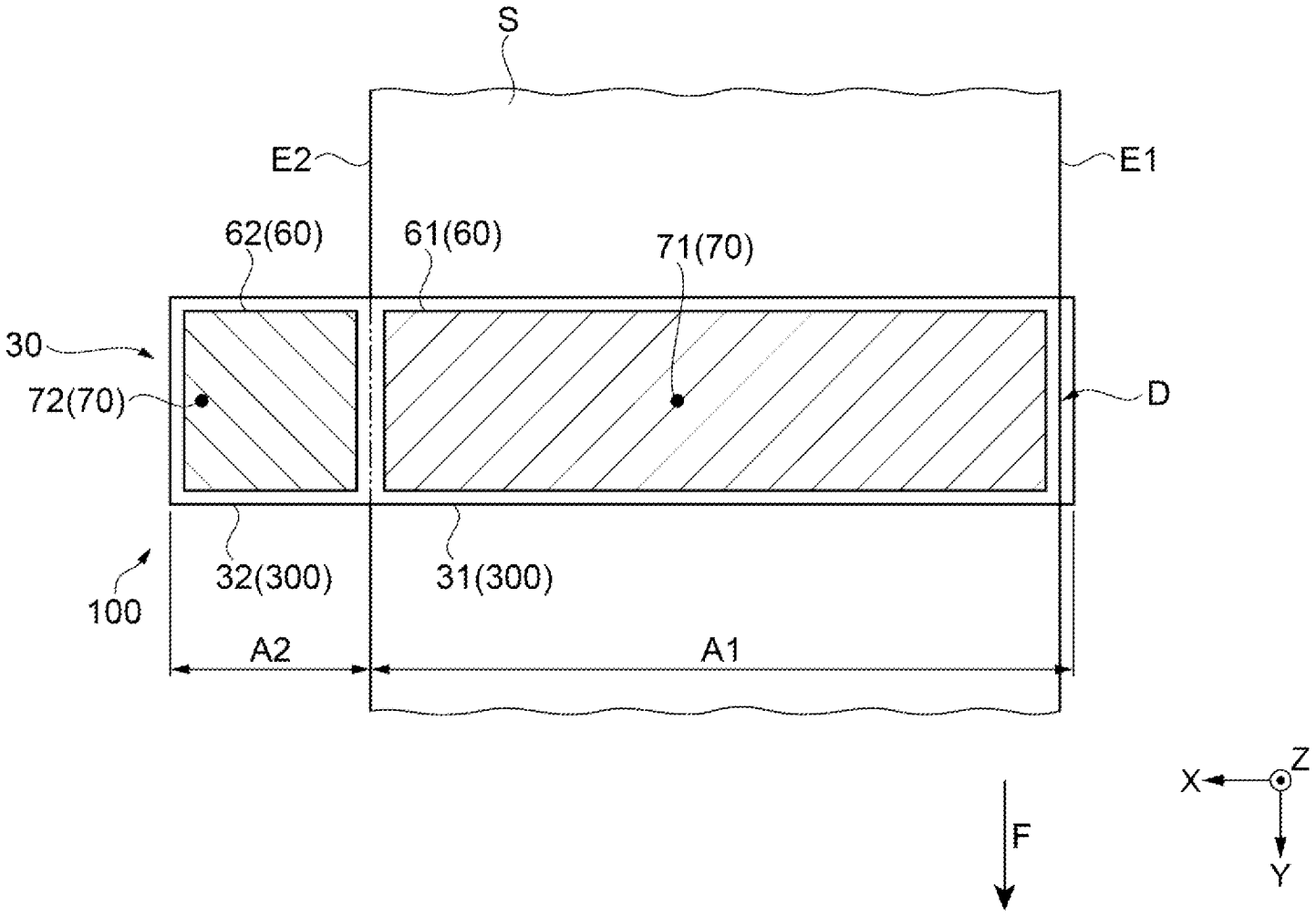
FIG. 3 is a plan view illustrating a platen as viewed from above.

As illustrated in FIG. 3, the heating device 100 of the present embodiment is configured to include the platen 30 as the support member supporting the sheet S, the heating unit 60 that heats the support face 300, which is the upper surface of the platen 30, from below, and the temperature detection unit 70 that is the detector detecting the temperature of the support face 300. Further, the heating device 100 also includes the above-described air blowing mechanism 40, the ejection heads 51 as a liquid ejecting unit, and the like.

On the upper surface of the platen 30, the support face 300 extends in the X direction, which is the width direction of the sheet S, and is formed in a rectangular shape. As illustrated in FIG. 3, the width direction of the sheet S is a long side of the support face 300, and the transport direction F is a short side thereof. Note that the width direction of the sheet S is the direction intersecting the transport direction F in which the sheet S is transported in the printer 1.

The sheet S is transported in the transport direction F while being in contact with and overlapping the support face 300. In the present embodiment, the support face 300 is configured by an aluminum plate material having excellent thermal conductivity. In the present embodiment, the size of the sheet S in the width direction is assumed to be, for example, 54 inches, 64 inches, or the like.

The platen 30 is disposed facing the ejection heads 51 serving as the liquid ejecting unit for ejecting the ink. In other words, the ejection heads 51 serving as the liquid ejecting unit are disposed facing the support face 300 provided on the platen 30.

In the present embodiment, a right-side end portion E1 of the sheet S is used as a reference for the sheet S when transporting the sheet S or when performing the printing on the sheet S. Then, the right-side end portion E1 of the sheet S is transported along a reference position D of the right-side (the negative X direction) end portion of the platen 30. Note that in the present embodiment, the reference position D at which the right-end portion E1 of the sheet S is positioned is substantially positioned at a right-side end portion of the first heated region 31, which will be described later.

In the present embodiment, the heating unit 60 that heats the support face 300 is installed in the platen 30. The heating unit 60 is installed in two sections in the width direction so as to substantially correspond to the width of the sheet S. The heating unit 60 is divided into the two sections substantially in alignment with a left-side end portion E2 of the sheet S.

As illustrated in FIG. 3, the heating unit 60 includes a first heating unit 61 on the right side, which is the side on which the sheet S is in contact with and overlaps the support face 300. Further, the heating unit 60 includes a second heating unit 62 on the left side, which is the side on which, although the sheet S comes into contact with the support face 300 due to variations, a ratio of a non-contact region is larger. Thus, the first heating unit 61 and the second heating unit 62 are arranged in the order of the first heating unit 61 and the second heating unit 62 from the center of the support face 300 toward the end on the left side in the width direction (in the positive X direction).

In the present embodiment, for example, both the first heating unit 61 and the second heating unit 62 configuring the heating unit 60 are configured by a tube heater. Further, the first heating unit 61 and the second heating unit 62 are disposed on the back side of the support face 300 (the back side of the aluminum plate member on which the support face 300 is formed). Note that in FIG. 3, a state is illustrated in which a gap is provided between the first heating unit 61 and the second heating unit 62 in the width direction of the support face 300. However, such a gap may be arranged to be as narrow as possible, or a configuration may be adopted in which there is no gap.

Here, a region of the support face 300 heated by the first heating unit 61 is the first heated region 31, and a region of the support face 300 heated by the second heating unit 62 is the second heated region 32. The second heated region 32 heated by the second heating unit 62 is positioned next to the first heated region 31 that is heated by the first heating unit 61.

Note that the heating unit 60 is divided, but the support face 300 is not divided, and the first heated region 31 and the second heated region 32 are coupled together to form the integral support face 300. Therefore, in FIG. 3, a boundary between the first heated region 31 and the second heated region 32 is set to be between the first heating unit 61 and the second heating unit 62 for ease of explanation, but in actuality, there is no clear boundary. In the present embodiment, the gap is provided in the width direction between the adjacent first heating unit 61 and second heating unit 62. Hereinafter, for ease of explanation, an intermediate position of the gap is considered to be the boundary between the first heated region 31 and the second heated region 32. Note that in FIG. 3 and FIG. 4, the boundary between the first heated region 31 and the second heated region 32 is indicated by a double dot chain line.

When the sheet S is transported, the position of the sheet S in the width direction varies due to variations in the placement of the sheet S when the sheet S is set in the printer 1, or skew variations when the sheet S is transported diagonally with respect to the transport path, and the like. For example, the variations in placement and skew variations in the present embodiment are each considered to be ±10 mm. In FIG. 3, although the planar position of the left-side end portion E2 of the sheet S is illustrated to be on the boundary between the first heated region 31 and the second heated region 32, the position of the sheet S actually varies in the width direction (the X direction). As a result, within a range of the variation, the planar position of the left-side end portion E2 of the sheet S may be located inside the second heated region 32, or may be located inside the first heated region 31.

Note that the position of the right-side end portion E1 of the sheet S will also vary in a similar manner, but in the present embodiment, the first heated region 31 is extended in the rightward direction (the negative X direction) such that the right-side end portion E1 is positioned inside the first heated region 31 even when there is the variation in the position of the right-side end portion E1.

A first detection unit 71 is installed on the support face 300 of the first heated region 31, as the temperature detection unit 70 that detects the temperature of the support face 300 of the first heated region 31. Note that the first detection unit 71 is installed in a substantially central portion, in the width direction, of the first heated region 31, which is the portion over which the sheet S is in contact with and overlaps the support face 300. Specifically, the first detection unit 71 is installed on the back side of the support face 300 (the back side of the aluminum plate on which the support face 300 is formed), at a location facing the substantially central portion, in the width direction, of the first heated region 31. Note that the first detection unit 71 is installed in a gap of lead wiring of the tube heater configuring the first heating unit 61.

A second detection unit 72 is installed on the support face 300 of the second heated region 32, as the temperature detection unit 70 that detects the temperature of the support face 300 of the second heated region 32. Note that the second detection unit 72 is installed, in the second heated region 32, at a location further to the opposite side from the first heating unit 61, than the center, in the width direction, of the second heated region 32. In other words, the second detection unit 72 is installed, in the second heated region 32, at a location at which the sheet S is less likely to come into contact with and overlap the support face 300, even when the position of the sheet S varies in the width direction.

As illustrated in FIG. 3, the second detection unit 72 is installed at the end portion on the left side (the negative X direction), in the second heated region 32. More specifically, the second detection unit 72 is installed on the back side of the support face 300 (the back side of the aluminum plate on which the support face 300 is formed). Further, the second detection unit 72 is installed in a gap of lead wiring of the tube heater configuring the second heating unit 62.

Figure 4:
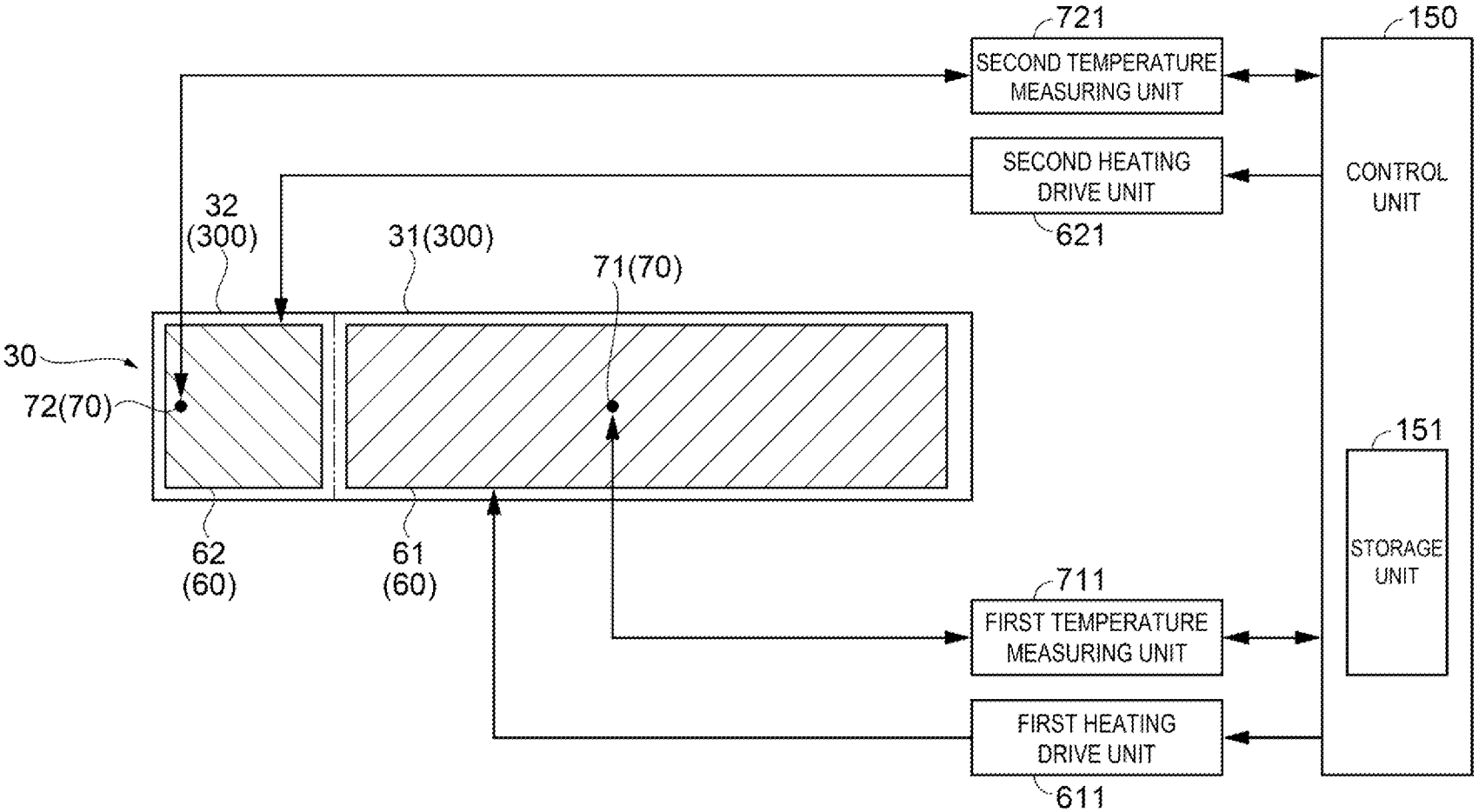
FIG. 4 is a diagram illustrating a configuration of a control system relating to a heating unit of the printer.

As illustrated in FIG. 4, control systems of the printer 1 include the control unit 150, a storage unit 151, the first heating unit 61, a first heating drive unit 611, the first detection unit 71, a first temperature measuring unit 711, the second heating unit 62, a second heating drive unit 621, the second detection unit 72, a second temperature measuring unit 721, and the like. Note that the heating device 100 is configured to include these control systems, and is operated by these control systems.

The control unit 150 includes a processor (not illustrated) that controls the printer 1 by executing programs, and the storage unit 151 that stores the programs executed by the processor, and data. The processor is an arithmetic processing device, such as a central processing unit (CPU), and controls each of the units of the printer 1 by executing control programs stored in the storage unit 151. Note that a PID control program, which will be described later, is also stored in the storage unit 151.

The first temperature measuring unit 711 measures, as a change of current, a change in resistance, using the first detection unit 71 (thermistor) that is installed in the first heated region 31, A/D converts an obtained current value, and transmits the current value to the control unit 150 as a measured temperature of the first heated region 31. In a similar manner to the first temperature measuring unit 711, the second temperature measuring unit 721 also measures, as the change of current, the change in resistance, using the second detection unit 72 (thermistor) that is installed in the second heated region 32, A/D converts an obtained current value, and transmits the current value to the control unit 150 as a measured temperature of the second heated region 32.

The first heating drive unit 611 supplies a power (voltage) specified by the control unit 150 to the first heating unit 61. In a similar manner, the second heating drive unit 621 supplies a power (voltage) specified by the control unit 150 to the second heating unit 62. The first heating unit 61 heats the first heated region 31 by generating heat using the power (voltage) supplied from the first heating drive unit 611. The second heating unit 62 heats the second heated region 32 by generating heat using the power (voltage) supplied from the second heating drive unit 621.

The control unit 150 according to the present embodiment operates the first heating drive unit 611 based on the detection by the first detection unit 71 (a signal input from the first temperature measuring unit 711), and controls the output of the first heating unit 61. In a similar manner, the control unit 150 operates the second heating drive unit 621 based on the detection by the second detection unit 72 (a signal input from the second temperature measuring unit 721), and controls the output of the second heating unit 62.

The control unit 150 detects the temperature of the first heated region 31 and the temperature of the second heated region 32, and independently controls the first heating unit 61 and the second heating unit 62 such that each of the temperatures is a predetermined temperature (target temperature). The control unit 150 controls the heating unit 60 using so-called PID control (proportional-integral-derivative control). Note that in the present embodiment, the predetermined temperature is 45° C. for both the first heated region 31 and the second heated region 32, for example. Further, when the sheet S is in contact with and overlaps the first heated region 31, a paper temperature is assumed to be 40° C., for example. Further, when a permissible temperature range is included, the temperature is, for example, 40° C.±3° C., or the like. Note that such a temperature is an example, and is a value appropriately set as a result of experimentation or the like.

The control unit 150 controls the temperature of the first heated region 31 and the temperature of the second heated region 32 to the predetermined temperature by driving the first heating drive unit 611 and the second heating drive unit 621. Thus, even when the environmental temperature in which the printer 1 is installed differs, by using the PID control, the temperature of the first heated region 31 and the temperature of the second heated region 32 are detected and fed back to the control unit 150, and are thus controlled appropriately. Note that the control unit 150 independently controls the output of the first heating unit 61 and the output of the second heating unit 62.

In known art, when a sheet overlaps a support face of a platen in a state in which the support face is heated to a uniform temperature, the temperature of the support face in a region with which the paper overlaps does not change significantly. However, the temperature of the support face in a region with which the sheet does not overlap experiences a temperature drop, due to heat dissipation. In this case, with respect to the temperature on an inner side of the sheet also, the temperature in regions at end portions of the sheet drops in comparison to the temperature in a region on the inner side of the sheet apart from the end portions (a central portion, for example). Further, in known art, in order to promote the drying of moisture in the ink using air, an air blowing mechanism is installed above the platen and air is blown onto the sheet. However, when the air blowing mechanism is operated, the temperature of the exposed support face drops further. In this case, the temperature in the regions of the end portions of the sheet drops further.

In this way, when a temperature difference occurs in the temperature in the width direction of the sheet and the temperature on a side at which the temperature drops is lower than the permissible temperature, the drying of the moisture when the ink is ejected cannot be uniformly promoted. On the end portion side at which the temperature of the paper drops, the drying of the moisture in the ink is not promoted, and a defect occurs more easily, such as an expansion in a dot diameter due to ink bleed-through, or the like. Note that the defect such as the expansion in the dot diameter due to the ink bleed-through is a factor that has a particularly large impact on a deterioration in printing quality, and is a factor that contributes most to the deterioration in printing quality.

In the case of the sheet S of the present embodiment, as described above, within the variation range, the left-side end portion E2 of the sheet S may be positioned inside the second heated region 32, or may be positioned inside the first heated region 31. Note that a configuration is adopted in which, even when the position of the left-side end portion E2 of the sheet S varies on the left side, and the left-side end portion E2 of the sheet S comes into contact with and overlaps the second heated region 32, a region that is exposed, in the width direction, is larger than the region of overlap.

Further, as illustrated in FIG. 3, a configuration is adopted in which a dimension A2 of the second heated region 32 in the width direction of the support face 300 is configured to be smaller than a dimension A1 of the first heated region 31 in the width direction (A2<A1). Therefore, a heat capacity of the second heated region 32 is lower than a heat capacity of the first heated region 31.

In the present embodiment also, in a similar manner to the known art, the temperature of the second heated region 32 that includes the region that does not overlap with the sheet S is more likely to drop compared to the temperature of the first heated region 31 of which substantially a whole region overlaps with the sheet S. However, the control unit 150 uses the PID control to control the output of the second heating unit 62, based on the temperature detected by the second detection unit 72 installed in the location not in contact with the sheet S, so as to cause the temperature of the second heated region 32 to approach the predetermined temperature of 45° C., and further, to maintain that temperature. Further, in a similar manner, in the first heated region 31 also, even when the temperature drop is not as great as in the second heated region 32, the control unit 150 uses the PID control to control the output of the first heating unit 61 based on the detection temperature detected by the first detection unit 71, so as to maintain the predetermined temperature of 45° C.

When the sheet S does not overlap the second heated region 32 and is positioned in the first heated region 31, the temperature of the region of the left-side end portion E2 of the sheet S, which is close to the second heated region 32, normally drops. However, because the temperature of the second heated region 32 can be maintained at the predetermined temperature as a result of the control unit 150 controlling the second heating unit 62, the temperature of the region of the left-side end portion E2 of the sheet S can be caused to be substantially the same as the temperature of the sheet surface on the inner side of the sheet S.

Note that, as described above, in the second heated region 32, the second detection unit 72 is installed in a location that is not in contact (does not overlap) with the sheet S, and detects the temperature of the support face 300 of the second heated region 32, and the control unit 150 controls the output of the second heating unit 62 in order to compensate for the temperature drop in the second heated region 32. Thus, when the region of the left-side end portion E2 of the sheet S overlaps with the second heated region 32, the temperature in the region of the left-side end portion E2 tends to be higher compared to a case in which the region of the left-side end portion E2 does not overlap with the second heated region 32. However, since the heat capacity of the second heated region 32 is less than the heat capacity of the first heated region 31, the amount of heat by which the region of the left-side end portion E2 of the sheet S is heated is small, and it is thus possible to suppress a temperature increase in the region of the left-side end portion E2.

Here, a description will be given of a defect when the second detection unit 72 is provided at a location further to the side of the first heating unit 61 than the center, in the width direction, of the second heated region 32, namely, in a location in the second heated region 32 with which the sheet S is in contact and overlaps, for example, when the position of the sheet S varies in the width direction. Note that, as described above, the configuration is adopted in which, even when the position of the left-side end portion E2 of the sheet S varies on the left side, and the left-side end portion E2 of the sheet S comes into contact and overlaps the second heated region 32, the region that is exposed, in the width direction, is larger than the region of overlap.

In the second heated region 32, when the second detection unit 72 is installed at a location at which the second detection unit 72 is in contact with the sheet S, a higher temperature is detected than the temperature of the exposed support face 300 that occupies the larger region of the second heated region 32. When control is performed based on the temperature of the support face 300 that occupies the smaller region of the second heated region 32, the heating of the second heated region 32 becomes insufficient, and the amount of heat of the second heated region 32 decreases. As a result, the temperature of the region of the left-side end portion E2 of the sheet S overlapping the second heated region 32 becomes a low temperature that is outside the permissible temperature range, compared to the temperature at the center of the sheet S.

Thus, as in the present embodiment, the configuration is adopted in which, even when the position of the left-side end portion E2 of the sheet S varies on the left side, and the left-side end portion E2 of the sheet S is in contact with and overlaps the second heated region 32, the region that is exposed, in the width direction, is larger than the region of overlap. Then, by providing the second detection unit 72 in the exposed support face 300 that occupies a larger portion of the second heated region 32, the temperature of the region of the left-side end portion E2 of the sheet S overlapping the second heated region 32 is slightly higher compared to the temperature of the central portion of the sheet S, but can be caused to fall within the permissible temperature range.

According to the above-described embodiment, the following advantages can be obtained.

The heating device 100 of the present embodiment is provided with the platen 30 that includes the support face 300 extending in the width direction of the sheet S and supporting the sheet S onto which the ink has been ejected, the first heating unit 61 provided in the platen 30 and configured to heat the support face 300 with which the sheet S is in contact, and the second heating unit 62 configured to heat the support face 300. Further, the control unit 150 is provided that controls the output of the first heating unit 61, and controls the output of the second heating unit 62 independently of the output of the first heating unit 61. Then, the second heated region 32 heated by the second heating unit 62 is positioned adjacent to the first heated region 31 that is heated by the first heating unit 61. In addition, the first heating unit 61 and the second heating unit 62 are arranged in the order from the center to the end of the support face 300 in the width direction. Then, in the second heated region 32 heated by the second heating unit 62, the second detection unit 72 that detects the temperature of the support face 300 is provided at a location further to the opposite side from the first heating unit 61, than the center, in the width direction, of the second heated region 32. Then, the control unit 150 controls the output of the second heating unit 62 based on the detection by the second detection unit 72.

According to the above-described configuration, in the second heated region 32 that forms the end portion of the support face 300 extending in the width direction, a region over which the sheet S is not in contact with the support face 300 is larger, and thus the temperature of the second heated region 32 is more likely to drop as a result of loss through heat dissipation. With respect to this, in the second heated region 32, the second detection unit 72, which detects the temperature of the support face 300, is provided at the location further to the opposite side from the first heating unit 61 than the center, in the width direction, of the second heated region 32 (in a location, in the second heated region 32, with which the sheet S will not come into contact even when the position of the sheet S in the width direction varies), and the control unit 150 controls the output of the second heating unit 62 independently of the output of the first heating unit 61. In this way, even when the temperature of the second heated region 32 drops, the temperature drop can be compensated for by increasing the output of the second heating unit 62 by an amount corresponding to the drop. As a result, a temperature difference between the end portion and the center portion of the sheet S can be suppressed. Thus, the fixing of the ink can be promoted uniformly, and the printing quality can be improved.

The heating device 100 according to the present embodiment is provided with the air blowing mechanism 40 that blows air onto the first heated region 31 and the second heated region 32.

In known art, when the air blowing mechanism is provided in order to accelerate the evaporation of ink moisture and further facilitate the fixing of the ink, using air, the temperature at the end portion of the paper significantly drops, and the temperature difference between the end portion and the center portion of the paper increases. However, by using the configuration of the present disclosure, by providing the air blowing mechanism 40, the temperature drop can be compensated for by increasing the output of the second heating unit 62, including the temperature drop in the second heated region 32 corresponding to the end portion of the sheet S. In this way, also when the air blowing mechanism 40 is provided, the temperature difference between the end portion (the region of the left-side end portion E2) and the center portion of the sheet S can be suppressed, and drying of the moisture of the ink can be further promoted.

The heating device 100 according to the present embodiment is provided with the ejection heads 51, as the liquid ejecting unit, that eject the ink onto the sheet S, and the ejection heads 51 are disposed facing the support face 300.

According to the above-described configuration, since the ejection heads 51 are disposed facing the support face 300, when ink is ejected onto the sheet S, the bleed-through of the ejected ink in the sheet S can be efficiently suppressed. Note that the expansion of the bleed-through of the ejected ink in the sheet S is a particularly large factor in terms of the impact on the printing quality. Thus, the support face 300 being disposed facing the ejection heads 51 means that the support face 300 is installed at a portion at which the impact on the printing quality is particularly large (a portion having a high contribution to the printing quality). The printing quality can thus be efficiently improved.

In the heating device 100 according to the present embodiment, the dimension A2 of the second heated region 32 in the width direction is smaller than the dimension A1 of the first heated region 31 in the width direction.

According to the above-described configuration, the dimension A2 of the second heated region 32 in the width direction is smaller than the dimension A1 of the first heated region 31, and thus, the heat capacity of the second heated region 32 is smaller than the heat capacity of the first heated region 31. Thus, when the control unit 150 detects the temperature of the support face 300 of the second heated region 32, using the second detection unit 72 installed at the location with which the sheet S does not come into contact, and controls the output so as to compensate for the temperature drop, since the heat capacity of the second heated region 32 is smaller than the heat capacity of the first heated region 31, the amount by which the region of the left-side end portion E2 of the sheet S is heated decreases, and it is possible to suppress the temperature increase in the region of the left-side end portion E2.

The printer 1, which is the recording device according to the present embodiment, is provided with the above-described heating device 100.

According to the above-described configuration, by providing the heating device 100 described above, it is possible to suppress the temperature difference between the end portion and the center portion of the sheet S, and a recording device that can improve the printing quality can be realized.

2. Second Embodiment

Figure 5:
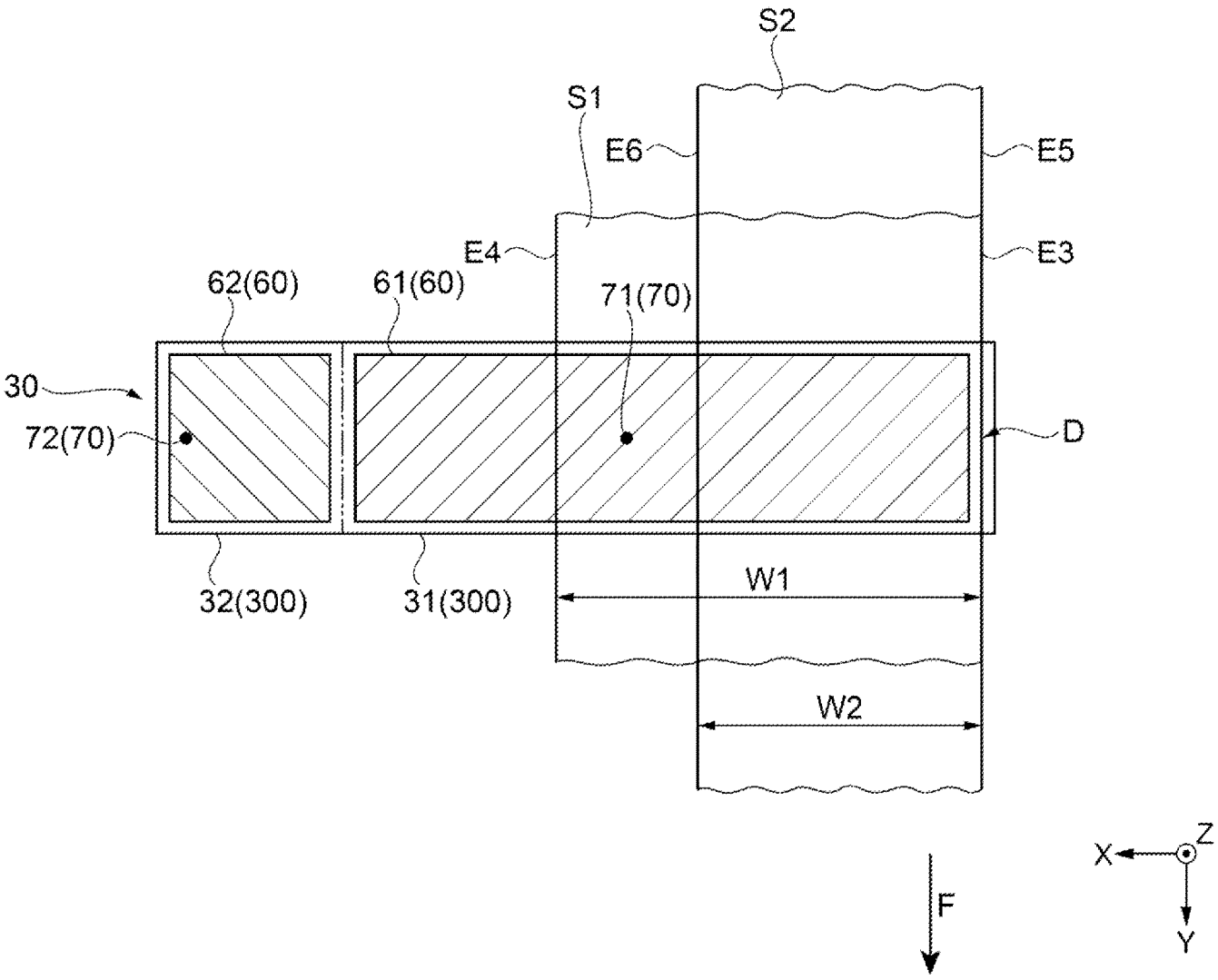
FIG. 5 is a plan view illustrating a platen according to a second embodiment, as viewed from above.

With reference to FIG. 5, the present embodiment is an embodiment specifically describing a location at which the first detection unit 71 described in the first embodiment is installed.

In the first embodiment, it is assumed that the sheet S having the sheet width of 54 inches or 64 inches, for example, is used as the sheet S. In the present embodiment, it is assumed that the sheet S having the sheet width less than 54 inches, which is affected by the installation location of the first detection unit 71, is used.

Note that the same reference signs are assigned to the configuration that is the same as that of the first embodiment, and a repeated description thereof is omitted here.

As illustrated in FIG. 5, the platen 30 supports the sheet S having a first dimension (a sheet width W1), for example. When transported, the sheet S having the paper width W1 passes through the center, in the width direction, of the first heated region 31 of the support face 300. Hereinafter, this sheet S is referred to as a sheet S1. Further, the platen 30 supports the sheet S having a second dimension (a sheet width W2), for example. When transported, the sheet S having the sheet width W2 does not pass through the center, in the width direction, of the first heated region 31 of the support face 300. Hereinafter, this sheet S is referred to as a sheet S2.

Here, when a convex rib or the like is provided in the center in the width direction of the first heated region 31, for example, the sheet S1 cannot come into contact with the support face 300 and thus, an expression referring to the sheet S1 being transported while in contact with and overlapping the support face 300 is inappropriate. Including this type of case also, an expression is used of passing over the support face 300.

In the present embodiment, the sheet S1 having the sheet width W1 of 36 inches, for example, is assumed as the sheet S1. Further, the sheet S2 having the sheet width W2 of 24 inches, for example, is assumed as the sheet S2. Both the sheet S1 and S2 are transported while being in contact with the support face 300, in the first heated region 31.

With respect to both end portions, in the width direction, of the sheet S1, the right end portion is referred to as a right-side end portion E3 and the left end portion is referred to as a left-side end portion E4. Further, with respect to both end portions, in the width direction, of the sheet S2, the right end portion is referred to as a right-side end portion E5 and the left end portion is referred to as a left-side end portion E6. Note that, in a similar manner to the sheet S according to the first embodiment, the right-side end portion E3 of the sheet S1 and the right-side end portion E5 of the sheet S2 are transported in the transport direction F taking the reference position D as the reference.

Here, when transporting the sheet S1, it is necessary to install the first detection unit 71 so that the temperature difference between the center portion in the width direction of the sheet S1 and the end portion (the left-side end portion E4) falls within the permissible temperature range (that is, the temperature difference is suppressed). Further, when transporting the sheet S2, it is necessary to install the first detection unit 71 so that the temperature difference between the center portion in the width direction of the sheet S2 and the end portion (the left-side end portion E6) falls within the permissible temperature range (that is, the temperature difference is suppressed). Thus, when transporting the sheets S1 and S2 separately, it is necessary to install the first detection unit 71, which is used to detect the temperature of the support face 300 of the first heated region 31 in both cases, so that the temperature difference between the center portion and the end portion (the left-side end portion) falls within the permissible temperature range (that is, the temperature difference is suppressed).

Since the sheet S1 having the sheet width W1 is the sheet passing through the center of the first heated region 31, a region of the support face 300, in the first heated region 31, with which the sheet S1 comes into contact and overlaps is larger than a region with which the sheet S1 does not come into contact and which is exposed. As a result, in more detail, the temperature of the sheet S1 heated by the first heated region 31 is more likely to be affected by the temperature of the support face 300 with which the sheet S1 is in contact. Thus, in the present embodiment, the first detection unit 71 is installed in a portion of the first heated region 31 with which the sheet S1 is in contact.

Since the sheet S2 having the sheet width W2 is the sheet that does not pass through the center of the first heated region 31, a region of the support face 300, in the first heated region 31, with which the sheet S2 comes into contact and overlaps is smaller than a region with which the sheet S2 does not come into contact and which is exposed. As a result, in more detail, the temperature of the sheet S2 heated by the first heated region 31 is more likely to be affected by the temperature of the support face 300 with which the sheet S2 is not in contact and which is exposed. Thus, in the present embodiment, the first detection unit 71 is installed in the first heated region 31 at a location at which the first detection part 71 is exposed without coming into contact with the sheet S2.

Thus, in the present embodiment, as illustrated in FIG. 5, in the first heated region 31, the first detection unit 71 that detects the temperature of the support face 300 is installed in a location, in the first heated region 31, through which the sheet S1 having the sheet width W1 passes, and through which the sheet S2 having the sheet width W2 does not pass. In this way, with respect to the sheet S1, the first detection unit 71 detects the temperature of the support face 300 that comes into contact with the sheet S1. Further, with respect to the sheet S2, the first detection unit 71 detects the temperature of the support face 300 that does not come into contact with the sheet S2. Then, the control unit 150 controls the output of the first heating unit 61 based on the temperature of the support face 300 detected by the first detection unit 71.

Note that, here, an inner side temperature of the sheet S1 will be described using a case in which the sheet S1 is transported, when the first detection unit 71 is not installed in a location, in the first heated region 31, with which the sheet S1 comes into contact, and, for example, is installed at a location with which the sheet S1 does not come into contact and is exposed.

As described above, the sheet S1 is more likely to be affected by the temperature of the support face 300 with which the sheet S1 is in contact. However, when the first detection unit 71 is installed in a location that is exposed, and control is performed to compensate for the temperature drop caused by heat dissipation, the entire sheet S1 is heated, the temperature of the sheet S1 becomes overheated, and becomes a temperature outside of the permissible temperature range.

In contrast, in the case of the sheet S1 in the present embodiment, the first heating part 61 is controlled based on the temperature of the support face 300 that is in contact with the sheet S1, and thus, the temperature of the left-side end portion E4 of the sheet S1 becomes lower than the temperature of the central portion of the sheet S1, as a result of being affected by the drop in temperature of the support face 300 that is exposed. However, since an area of the region in which there is contact is larger than an area of the exposed region, the heat capacity of the region in which there is contact is larger than the heat capacity of the exposed region. As a result, the difference in temperature by which the left-side end portion E4 drops in comparison with the temperature of the central portion decreases, and the temperature falls within the permissible temperature range.

Here, an inner side temperature of the sheet S2 will be described using a case in which the sheet S2 is transported, when the first detection unit 71 is not installed in a location, in the first heated region 31, with which the sheet S1 does not come into contact, and, for example, is installed at a location with which the sheet S2 comes into contact. As described above, the sheet S2 is more likely to be affected by the temperature of the exposed support face 300. However, when the first detection unit 71 is installed in a location at which there is contact and is controlled, it is not possible to compensate for the temperature drop resulting from the heat dissipation of the exposed support face 300, the temperature of the sheet S2 as a whole drops, and becomes a temperature outside the permissible temperature range.

In contrast, in the case of the sheet S2 according to the present embodiment, the first heating part 61 is controlled based on the temperature of the support face 300 that is exposed and does not come into contact with the sheet S2, and thus, the overall temperature of the sheet S2 increases as a result of being affected by the temperature of the exposed support face 300. However, since the area of the region in which there is contact is smaller than the area of the exposed region, the heat capacity of the region in which there is contact is smaller than the heat capacity of the exposed region. As a result, the overall temperature of the sheet S2 is appropriately increased, and becomes a temperature within the permissible temperature range.

According to the present embodiment, the following advantages can be obtained in addition to the advantages of the first embodiment.

In the heating device 100 according to the present embodiment, the platen 30 supports the sheet S1 having the first dimension (the sheet width W1) that passes through the center, in the width direction, of the first heated region 31. Further, the platen 30 supports the sheet S2 having the second dimension (the sheet width W2) that does not pass through the center, in the width direction, of the first heated region 31. Then, the first detection unit 71 that detects the temperature of the support face 300 of the first heated region 31 is installed, in the first heated region 31, in a location through which the sheet S1 passes, and through which the sheet S2 does not pass. Further, the control unit 150 controls the output of the first heating unit 61 based on the detection by the first detection unit 71.

According to the above-described configuration, as with the sheet S1, a state may be obtained in which, in the first heated region 31, a proportion over which the sheet S1 is in contact with and overlaps the support face 300 is large, and a proportion of the support face 300 that is exposed is small.

Further, as with the sheet S2, a state may be obtained in which, in the first heated region 31, a proportion over which the sheet S2 is in contact with and overlaps the support face 300 is small, and a proportion of the support face 300 that is exposed is large. However, in both cases, the first detection unit 71 is installed, in the first heated region 31, at the location through which the sheet S1 passes and the sheet S2 does not pass. Thus, by the control unit 150 performing the control based on the detected temperature of the first detection unit 71, the temperature of both the sheet S1 and the sheet S2 can be appropriately caused to be the temperature within the permissible temperature range. Thus, for each of the sheet S1 and the sheet S2, a temperature difference between the end portion (the left-side end portions E4, E6) and the central portion can be suppressed, the fixing of the ink can be promoted uniformly, and the printing quality can be improved.

3. First Modified Example

With respect to the sheet S of the first embodiment, the sheet S is assumed to have a size in the width direction of 54 inches, 64 inches, or the like. However, the sheet S is not limited thereto, and may be the sheet S having a sheet width greater than 64 inches.

4. Second Modified Example

In the first embodiment, for ease of explanation, boundaries of the left-side end portion E2 of the sheet S and of the heating unit 60 are aligned with each other, but need not necessarily be aligned with each other. Taking the variations in the position of the sheet S, and the like into account, the heating unit 60 may be divided as appropriate.

5. Third Modified Example

In the first embodiment, the second detection unit 72 is installed at the end portion side on the left side (the positive X direction) in the second heated region 32. However, the position of the second detection unit 72 is not limited thereto, and it is sufficient that the second detection part 72 be installed, in the second heated region 32, at a location at which the sheet S does not come into contact with and overlap the support face 300, even when the position of the sheet S varies in the width direction.

6. Fourth Modified Example

In the first embodiment and the second embodiment, the heating device 100 is applied to the platen 30. However, the configuration is not limited thereto, and the heating device 100 may be applied to the winding guide unit 172 (see FIG. 2). In this case, the heating device 100 has a configuration that does not include the ejection heads 51. In this way, wrinkles and the like generated at the end portion of the sheet S can be suppressed.

7. Fifth Modified Example

In the first embodiment, the sheet S is transported while the right-side end portion E1 is aligned with the reference position D. However, the configuration is not limited thereto, and a configuration may be adopted in which the sheet S is transported while the central portion of the sheet S is aligned with the center of the first heated region 31, as a reference, namely, a so-called central alignment configuration may be adopted. In this case, taking the center of the first heated region 31 as a reference, the same configuration of the heating device 100 as in the first embodiment may be applied symmetrically to both sides in the width direction (the X direction). Specifically, in this case, the configuration may include two of the first heated regions and two of the second heated regions, or the configuration may include one of the first heated regions and two of the second heated regions. Even with this type of configuration, the same advantages as those of the first embodiment can be obtained.

What is claimed is:

1. A heating device comprising:

a support member including a support face extending in a width direction of a medium and configured to support the medium onto which a liquid is ejected;

a first heating unit provided at the support member and configured to heat the support face contacted by the medium;

a second heating unit provided at the support member and configured to heat the support face; and a control unit configured to control an output of the first heating unit, and to control an output of the second heating unit independently of the output of the first heating unit, wherein a second heated region heated by the second heating unit is positioned adjacent to a first heated region heated by the first heating unit, the first heating unit and the second heating unit are arranged, in order, from a center of the support face toward an end of the support face in the width direction, a second detection unit configured to detect a temperature of the support face is provided at the second heated region heated by the second heating unit, the second detection unit being provided at a location further from the first heating unit than a center of the second heated region in the width direction, and the control unit controls an output of the second heating unit based on detection by the second detection unit.

2. The heating device according to claim 1, comprising:

an air blowing mechanism configured to blow air onto the first heated region and the second heated region.

3. The heating device according to claim 1, comprising:

a liquid ejection unit configured to eject the liquid onto the medium, wherein the liquid ejection unit faces the support face.

4. The heating device according to claim 1, wherein the support member supports a medium having a first dimension that, when transported, passes through a center of the first heated region in the width direction, and a medium having a second dimension that, when transported, does not pass through the center of the first heated region in the width direction, a first detection unit configured to detect a temperature of the support face is provided, in the first heated region, at a location through which the medium having the first dimension passes and the medium having the second dimension does not pass, and the control unit controls an output of the first heating unit based on detection by the first detection unit.

5. The heating device according to claim 1, wherein a dimension of the second heated region in the width direction is smaller than a dimension of the first heated region in the width direction.

6. A recording device comprising:

the heating device according to claim 1.

* * * * *